US010134546B2

(12) United States Patent
Li

(10) Patent No.: US 10,134,546 B2
(45) Date of Patent: Nov. 20, 2018

(54) MAXIMIZING WALL THICKNESS OF A CU—CR FLOATING CENTER SHIELD COMPONENT BY MOVING CONTACT GAP AWAY FROM CENTER FLANGE AXIAL LOCATION

(71) Applicant: EATON CORPORATION, Cleveland, OH (US)

(72) Inventor: Wangpei Li, Horseheads, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 14/946,941

(22) Filed: Nov. 20, 2015

(65) Prior Publication Data

US 2017/0148590 A1 May 25, 2017

(51) Int. Cl.
*H01H 33/662* (2006.01)
*H01H 33/66* (2006.01)

(52) U.S. Cl.
CPC .. *H01H 33/66207* (2013.01); *H01H 33/6606* (2013.01); *H01H 33/66261* (2013.01); *H01H 2033/66269* (2013.01)

(58) Field of Classification Search
CPC ..... H01H 33/66261; H01H 33/662017; H01H 2033/66269; H01H 33/662; H02H 9/046; H02H 9/06; H01T 2/02
USPC ..... 218/136, 118, 132–134; 361/120; 200/144 B
See application file for complete search history.

(56) References Cited

U.S. PATENT DOCUMENTS 3,355,564 A * 11/1967 Ranheim ..... H01H 33/66207 174/152 GM
4,149,050 A * 4/1979 Gorman ..... H01H 33/6642 218/128
4,553,007 A 11/1985 Wayland
4,737,605 A * 4/1988 Bettge ..... H01H 33/6645 218/136
5,438,174 A * 8/1995 Slade ..... H01H 33/6644 218/118

(Continued)

FOREIGN PATENT DOCUMENTS

DE 39 32 159 A1 4/1991
DE 196 25 737 A1 1/1997

(Continued)

OTHER PUBLICATIONS

European Patent Office, "International Search Report and Written Opinion" PCT/US2016/055640, dated Dec. 20, 2016, 13 pp.

*Primary Examiner* — Renee Luebke
*Assistant Examiner* — William Bolton
(74) *Attorney, Agent, or Firm* — Eckert Seamans

(57) ABSTRACT

The disclosed concept relates to vacuum interrupters having an electrically floating arc-enduring center shield component made out of an alloy of copper (Cu) and chromium (Cr), with or without additional minority alloying element or elements, and contact assemblies positioned in a vacuum envelope. In an open position, the contact assemblies include a contact gap formed there between. In accordance with the invention, contact assemblies are axially positioned such that the axial position of the contact gap aligns with a portion of the wall of the Cu—Cr alloy-based center shield component that has a maximum thickness and outer diameter.

7 Claims, 10 Drawing Sheets

(56) References Cited

U.S. PATENT DOCUMENTS

| | | | | |
|---|---|---|---|---|
| 6,417,473 | B1 * | 7/2002 | Mayo | H01H 33/66261 218/136 |
| 8,039,771 | B2 * | 10/2011 | Trondsen | H01H 33/66261 218/136 |
| 9,025,299 | B2 * | 5/2015 | Shea | H01T 2/02 361/120 |
| 2013/0147590 | A1 * | 6/2013 | Ledbetter | H01F 27/28 336/192 |

FOREIGN PATENT DOCUMENTS

| | | | |
|---|---|---|---|
| DE | 10 2004 061497 | A1 | 7/2006 |
| JP | 3 194599 | B2 | 7/2001 |

* cited by examiner

MAXIMIZING WALL THICKNESS OF A CU—CR FLOATING CENTER SHIELD COMPONENT BY MOVING CONTACT GAP AWAY FROM CENTER FLANGE AXIAL LOCATION

BACKGROUND

Field

The disclosed concept pertains generally to vacuum circuit breakers and other types of vacuum switchgear and related components, such as vacuum interrupters and shield walls. In particular, the disclosed concept pertains to axially positioning a pair of separable contact assemblies located in a vacuum envelope of a vacuum interrupter employing a floating center shield component composed of copper-chromium alloy-based material, such that the contact gap between the opposing contact surfaces of the assemblies aligns with a portion of the shield wall having a maximum thickness and outer diameter.

Background Information

Vacuum interrupters are typically used to interrupt high voltage AC currents. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to the external circuit.

An arc is typically formed between the contact surfaces when the contacts are moved apart to the open circuit position. The arcing continues until the current is interrupted. Metal from the contacts that is vaporized by the arc forms a neutral plasma during arcing and condenses back onto the contacts and also onto a vapor shield placed between the contact assemblies and the vacuum envelope.

The vacuum envelope of the interrupter typically includes a ceramic tubular insulating casing with a metal end cap or seal covering each end. The electrodes of the vacuum interrupter extend through the end caps into the vacuum envelope.

Vacuum interrupters are key components of vacuum-type switchgear. It is typical for interrupters for vacuum-type circuit breakers using transverse magnetic field contacts to include a tubular center shield to protect the internal wall of the tubular insulating casing from being coated with the metallic product of the burning of the arc on the contacts. The tubular center shield can be mounted and electrically connected to either one end of the metallic construction of the vacuum interrupter; in this case the center shield is called fixed. Alternatively the center shield can be mounted, via a center flange, to the tubular insulating casing and electrically insulated from either of the metallic ends of the vacuum interrupter; in this construction the center shield is called floating. The center shield can be an assembly of multiple components. For example, U.S. Pat. No. 4,020,304 prescribes a center shield assembly consisting of a middle portion made out of copper and two end portions made out of stainless steel.

As prescribed in U.S. Pat. No. 4,553,007, it is advantageous for the arcing portion of the tubular center shield, that is, the portion of the center shield surrounding the contact gap, to be made out of a material comprised of the same two metallic components as the separable metallic electric contacts, which for all practical purpose are copper and chromium. The employment of a center shield with the arcing portion made out of copper-chromium alloy material allows a close proximity of the shield to the contacts, as such a shield is capable of enduring not only the unintentional bowing out to the shield of the burning arc in between the two separating contacts, but also intentional participation and sharing of the arcing duty required to interrupt a high current. For that reason, center shields with the arcing portion made out of copper-chromium (Cu—Cr) alloy-based material are often used in vacuum interrupters for the highest fault current ratings, especially those of the transverse or radial magnetic field type.

FIG. 1 is a cross-section view of a vacuum interrupter 10 in accordance with the prior art, which employs a center shield component 24 made out of arc-enduring Cu—Cr alloy-based material. FIG. 1 shows a cylindrical insulating tube 12, consisting of two cylindrical pieces which, in combination with end seals 51 and 52, forms a vacuum envelope 50. The center shield component 24 is secured to the insulating tube 12 by a center flange 25 that is typically braze-joined. The center shield component 24 surrounds a first electrode assembly 20 and a second electrode assembly 22 to prevent metal vapor from collecting on the insulating tube 12, and to prevent an arc from hitting the insulating tube 12. The insulating tube 12 is preferably made of a ceramic material such as alumina, zirconia or other oxide ceramics, but may also be glass. The Cu—Cr alloy-based center shield component 24 is the middle portion of a center shield assembly, which also includes opposing metal end components 13, 15. Overlaps 37, 38 are formed by a metal portion of the end components 13, 15, respectively, overlapping a portion of the Cu—Cr alloy-based center shield component 24. The first and second electrode assemblies 20 and 22, respectively, are axially aligned within the vacuum envelope 50. The first electrode assembly 20 includes a bellows 28, a bellows shield 48, a first electrode contact 30, a first terminal post 31, and a first vapor shield 32. The second electrode assembly 22 includes a second electrode contact 34, a second terminal post 35, a second vapor shield 36, and an end shield 58. While the vacuum envelope 50 shown in FIG. 1 is part of the vacuum interrupter 10, it is to be understood that the term "vacuum envelope" as used herein is intended to include any sealed component having a ceramic to metal seal which forms a substantially gas-tight enclosure. Such sealed enclosures may be maintained at sub-atmospheric, atmospheric or super-atmospheric pressures during operation.

The first and second electrode assemblies 20 and 22, respectively, are axially movable with respect to each other for opening and closing the AC circuit. The bellows 28 mounted on the first electrode assembly 20 seal the interior of the vacuum envelope 50 formed by the insulating tube 12 and end seals 51 and 52, while permitting movement of the first electrode assembly 20 from a closed position as to an open circuit position (as shown in FIG. 1). The first electrode contact 30 is connected to the generally round first terminal post 31 which extends out of the vacuum envelope 50 through a hole in the end seal 51. The first vapor shield 32 and the bellows shield 48 are mounted on the first terminal post 31 in order to keep metal vapor off the bellows 28 and the insulating tube 12. Likewise, the second electrode contact 34 is connected to the generally round second terminal post 35 which extends through the end seal 52. The second vapor shield 36 and the end shield 58 are mounted on the second terminal post 35 to protect the insulating tube 12 from metal vapor. The second terminal post 35 is rigidly and hermetically sealed to the end seal 52 by means such as, but not limited to, welding or brazing. The center shield component 24 is not electrically connected to, and hence is electrically floating from, either the first or the second electrode assemblies 20 and 22.

FIG. 1A is a detail view of the vacuum interrupter 10 and the center shield assembly consisting of the arc-enduring Cu—Cr alloy-based center shield component 24 and, opposing metal end components 13, 15 shown in FIG. 1, when the vacuum interrupter 10 is in an open position, with an axial contact gap 14 formed between the surfaces of the first and second electrode contacts 30, 34 of the first and second electrode assemblies 20, 22, respectively. As shown in FIG. 1A, there is an empty, unused space 26 located between an outer diameter 27 of the center shield component 24 and the inner diameter 23 of the insulating tube 12 and therefore, the wall thickness of the center shield component 24 is not maximized. As a result, when subjected to interruption duties of a high number of shots of a high current or long arcing duration, as in the case of an asymmetrical current, the center shield wall is easily burned through.

Generally, an electrically floating center shield assembly is secured to the vacuum interrupter envelope via a center flange that is more susceptible to being braze-joined to or otherwise securely positioned with the insulating ceramic casing of the vacuum interrupter envelope. The cylindrical center shield assembly is slid into the ring-shaped flange opening. The maximum outer diameter (OD) of the center shield component is thus limited by the internal diameter (ID) of the center flange. The maximum OD of the center shield component is typically no more than a few thousands of an inch larger—for press fitting—than the smallest value of the ID of the center flange. This, in turn, limits the maximum diameter of the contacts that can be fitted inside the center shield component. As the diameter of the contacts is increased, there is a greater risk of burning through the shield wall due to a number of fault currents of a high amplitude.

There is known a vacuum interrupter and Cu—Cr alloy-based center shield design, wherein the maximum OD of the center shield component is larger than the ID of the opening of the center flange (e.g., snap-ring, in a particular embodiment). However, the thicker portion of the Cu—Cr shield wall is not employed to maximize the capability of the center shield component to withstand arc erosion because the contact gap is not aligned entirely with the thickest portion of the center shield wall. Instead, the thickest portion of the center shield wall is used for the purpose of creating a large enough step to secure the relatively heavy center shield to the center flange.

FIG. 2 is a cross-section view of a vacuum interrupter 10' in accordance with the prior art. FIG. 2 includes the vacuum envelope 50 consisting of the insulating tube 12 and the end seals 51 and 52, the arc-enduring Cu—Cr alloy-based center shield component 24 and the opposing metal end components 13, 15 (which form the center shield assembly), the overlaps 37 and 38, the first electrode assembly 20, the second electrode assembly 22, the bellows 28, the bellows shield 48, the first electrode contact 30, the first terminal post 31, the first vapor shield 32, the second electrode contact 34, the second terminal post 35, the second vapor shield 36, and the end shield 58 as shown in FIG. 1. In addition, the vacuum interrupter 10' also includes a center flange in the form of a snap-ring 25A (as shown in FIG. 2A) that is used to secure the arc-enduring Cu—Cr alloy-based center shield component to the insulating tube 12.

FIG. 2A is a detail view of the vacuum interrupter 10' as shown in FIG. 2, when the vacuum interrupter 10' is in the open position, with the contact gap 14 formed between the first and second electrode assemblies 20,22. As shown in FIG. 2A, there is no empty, unused space (26 as shown in FIG. 1A) between the outer diameter 27 of the center shield component 24 and the inner diameter 23 of the insulating tube 12. In contrast to FIG. 1A, FIG. 2A shows that a portion of the shield wall 29 has a maximum thickness. This portion of the shield wall 29 is created as a geometric step for securing the snap-ring flange 25A. The contact gap 14 is not positioned such that it is entirely in alignment with the shield wall 29 having a maximum thickness and outer diameter. As a result, when subjected to interruption duties of a high number of shots of a high current or long arcing duration, as in the case of an asymmetrical current, the center shield wall is easily burned through at the location where the wall thickness is not maximized.

FIG. 3 is a cross-section view of another vacuum interrupter 10" in accordance with the prior art. FIG. 3 includes the vacuum envelope 50 consisting of the insulating tube 12 and end seals 51 and 52, first electrode assembly 20, second electrode assembly 22, bellows 28, bellows shield 48, first electrode contact 30, first terminal post 31, second electrode contact 34, and second terminal post 35, as shown in FIGS. 1 and 2. As shown in FIG. 3, the vacuum interrupter 10" includes a center shield component 24A, which is secured to the insulating body 12 via a ledge on its internal (ID) wall. The rather complex shape of the center shield component 24A needed for such a mounting mechanism requires that it be made of a material that is not an arc-enduring Cu—Cr alloy-based material. For example, the center shield component 24A can be composed of a material that is more formable than an arc-enduring Cu—Cr alloy-based material, such as, but not limited to, pure copper or stainless steel.

FIG. 3A is a detail view of the vacuum interrupter 10" and non-arc-enduring (e.g., non-Cu—Cr alloy-based) center shield component 24A, as shown in FIG. 3, when the vacuum interrupter 10" is in the open position, with the contact gap 14 formed between the first and second electrode assemblies 20, 22. The mechanism for securing the center shield component 24A to the vacuum envelope 50 results in a shield wall 40 having a uniform thickness, e.g., there are no overlap locations to join a metal end to a non-metal end (of the Cu—Cr alloy-based center shield component), as shown in FIGS. 1A and 2A. That is, there are no overlaps 37, 38 (as shown in FIGS. 1A and 2A), each of which overlap a Cu—Cr alloy-based center shield wall. Thus, as shown in FIG. 3A, there is no thickness variation such that one portion of the shield wall can have a greater thickness than another portion of the shield wall. Such a shield made with a non-arc-enduring material serves solely the purpose of shielding the insulating tube 12, and does not actively participate in the arcing duty. When accidentally hit by the arcing in between the opening contacts, such a shield either melts excessively, in the case of a copper shield, or re-solidifies into dielectrically detrimental pointy features as in the case of a stainless steel shield. As a result, they have to be placed a significant distance (relatively far away) from the contact gap. In other words, only a relatively small diameter of the contacts can be employed for any given diameter of the center shield.

There is room for improvement in the design and manufacture of vacuum interrupters employing a center shield component composed of Cu—Cr alloy-based material, with or without additional minority alloying element or elements. It is an object of the disclosed concept to develop vacuum interrupters employing a floating center shield component composed of Cu—Cr alloy-based material, wherein the contact assemblies are axially positioned within the vacuum envelope such that the contact gap axial position is in alignment with a portion of the wall of the center shield component having a maximum thickness.

SUMMARY

These needs and others are met by embodiments of the disclosed concept, which provide arc-enduring Cu—Cr alloy-based center shield components constructed of these compositions.

In an aspect, the disclosed concept provides a vacuum interrupter, including an insulating tube having an inner diameter, a vacuum envelope formed by the insulating tube, an arc-enduring center shield component comprised of Cu—Cr alloy-based material having a shield wall and an outer diameter, and being positioned within the vacuum envelope, a center flange to secure the center shield component to the insulating tube, a first contact assembly, a second contact assembly, and a contact gap formed between the first and second contact assemblies when said assemblies are in an open position. The first and second contact assemblies are positioned such that the contact gap in its entirety is aligned with a portion of the shield wall that has a maximum thickness and outside diameter.

The portion of the shield wall can have an outer diameter that extends to or near the inner diameter of the insulating tube. The contact gap can be aligned with the portion of the shield located a distance away from a portion of the shield wall where the center flange is attached. The contact gap can be aligned with the portion of the shield wall that is located above the portion of the shield wall where the center flange is attached. The contact gap can be aligned with the portion of the shield wall that is located below the portion of the shield wall where the center flange is attached.

In certain embodiments, the center flange has a ring-shaped opening formed therein. The outer diameter of said portion of the shield wall of the arc-enduring Cu—Cr alloy-based center shield component can be larger than an inner diameter of the opening of the flange.

The insulating tube can be composed of ceramic. The center shield component can have connected thereto opposing ends composed of metal. The contact gap can have an axial position and the center flange can have an axial position, and the axial position of the contact gap can be located above or below the axial position of the center flange.

BRIEF DESCRIPTION OF DRAWINGS

A full understanding of the disclosed concept can be gained from the following description of the preferred embodiments when read in conjunction with the accompanying drawing in which.

DETAILED DESCRIPTION OF PREFERRED EMBODIMENTS

The disclosed concept relates to vacuum interrupters employing a floating center shield assembly and contact assemblies positioned in a vacuum envelope. The center shield assembly includes a center shield component (or middle portion) composed of an arc-enduring Cu—Cr alloy-based material, and opposing ends composed of metal. In an open position, the contact assemblies include an axial contact gap formed there between. In accordance with the invention, contact assemblies are axially positioned such that the axial position of the contact gap aligns with a portion of the wall of the center shield component that has a maximum thickness and outer diameter. In certain embodiments, the contact assemblies are axially positioned such that the contact gap axial position is located outside of or away from, e.g., above or below, the center flange axial position. In these embodiments, the contact gap aligns with a portion of the wall of the center shield component having a maximum thickness and outer diameter. That is, the thickness and outer diameter of the center shield is not limited by the diameter of the center flange or flange opening.

There are various benefits to be derived from positioning the contact gap between the contact assemblies such as to align with a portion of the Cu—Cr alloy-based center shield wall having a maximum thickness and outer diameter. For example, this alignment can prevent the center shield component from being burned through. Additional benefits can include one or more of the following:

Enables the use of a larger diameter of the contact assemblies, thereby increasing the current interruption performance for a given vacuum interrupter size, which is typically defined by the diameter of the ceramic envelope;

Enables, for a given contact diameter, a larger inner diameter of the center shield component, thereby enabling a larger clearance from the contact outer diameter to improve the dielectric (e.g., voltage withstand) performance for a given vacuum interrupter size; and Maximizes the unique capability of the center shield component in sharing the arcing duty from the contacts, thereby enabling the entire vacuum interrupter to endure more arc erosion by a higher number of shots and/or a longer duration of the shots, which improves the electrical life of the vacuum interrupter.

Figure 1:
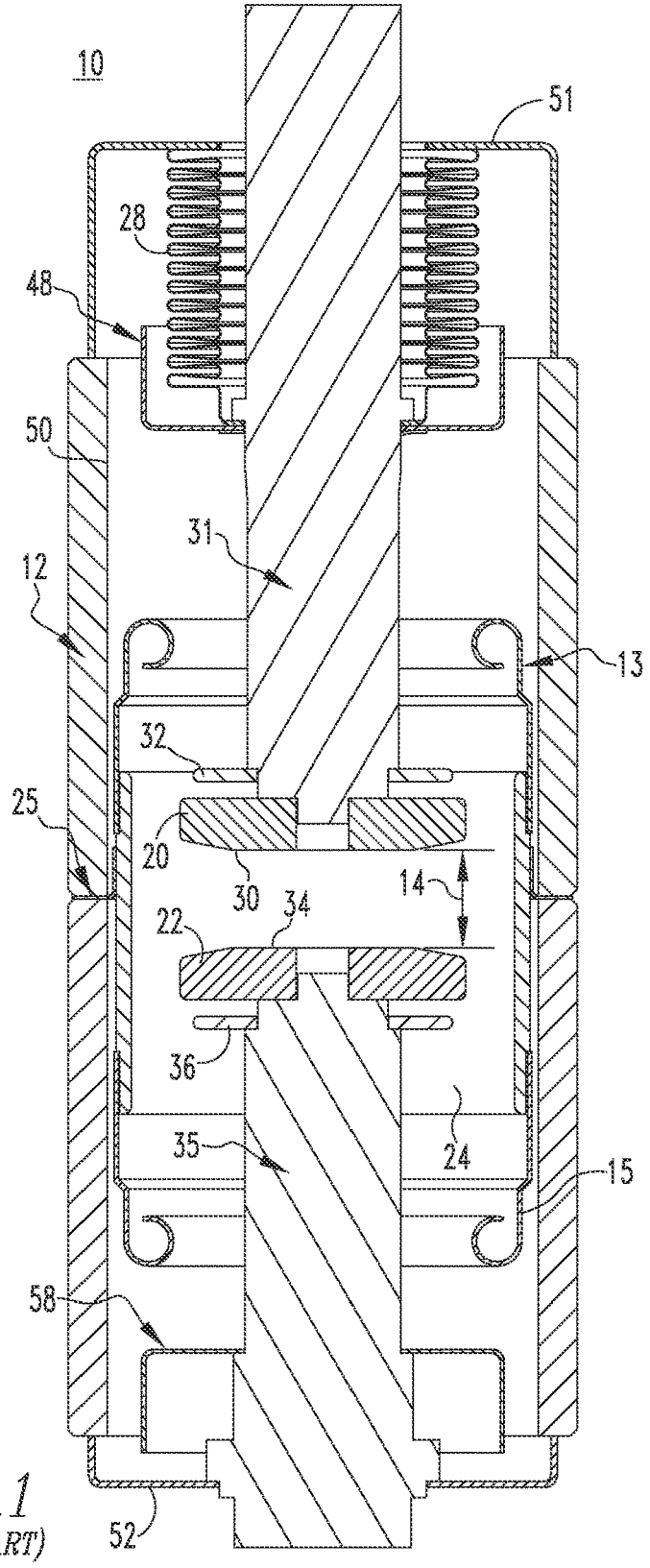
FIG.1 (PRIOR ART)
FIG. 1 is a sectional view of a vacuum interrupter and an arc-enduring Cu—Cr alloy-based center shield component, in accordance with the prior art.
Figure 1A:
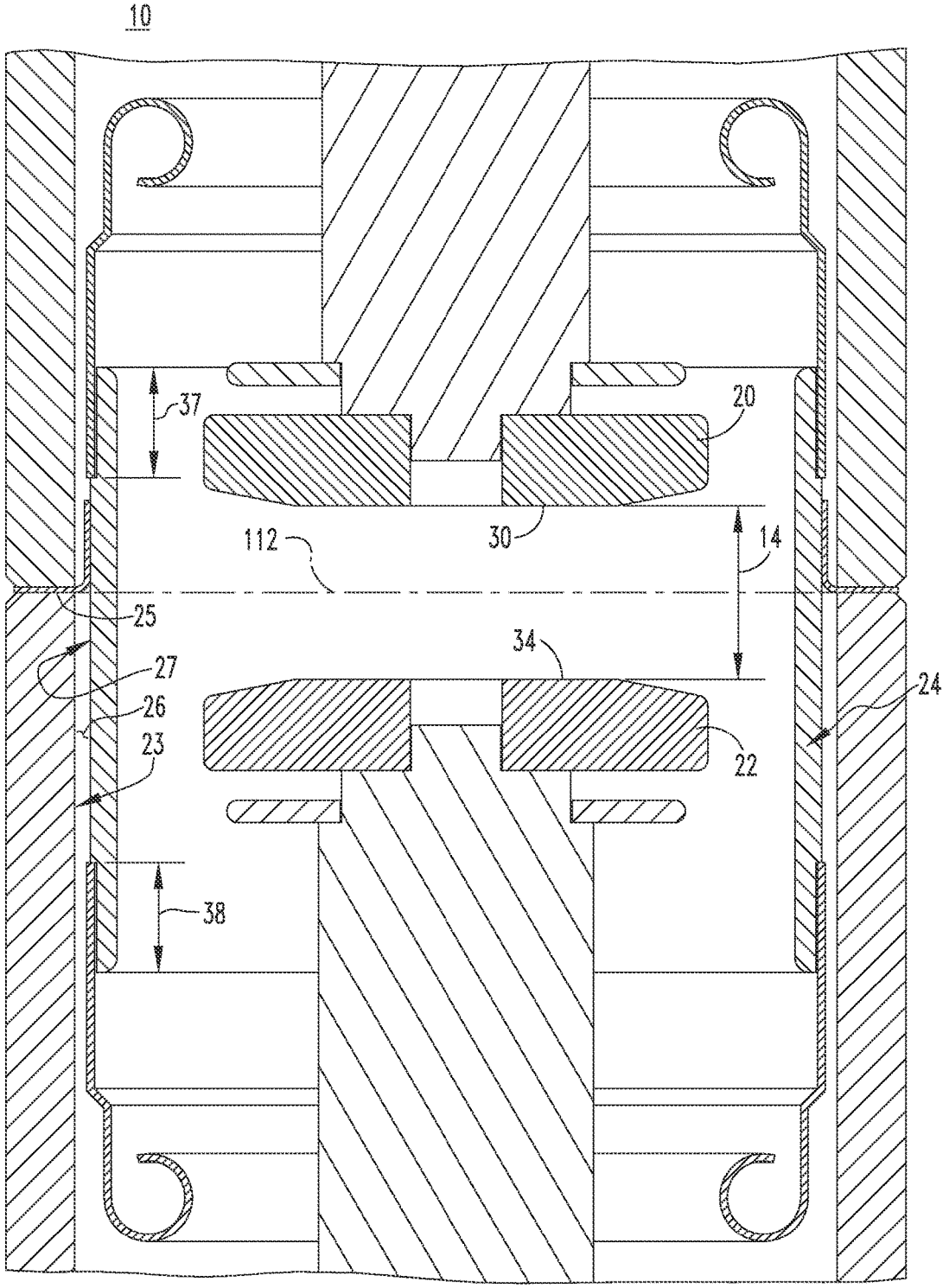
FIG.1A (PRIOR ART)
FIG. 1A is a detail view of FIG. 1 of the contact gap portion, in accordance with the prior art.
Figure 2:
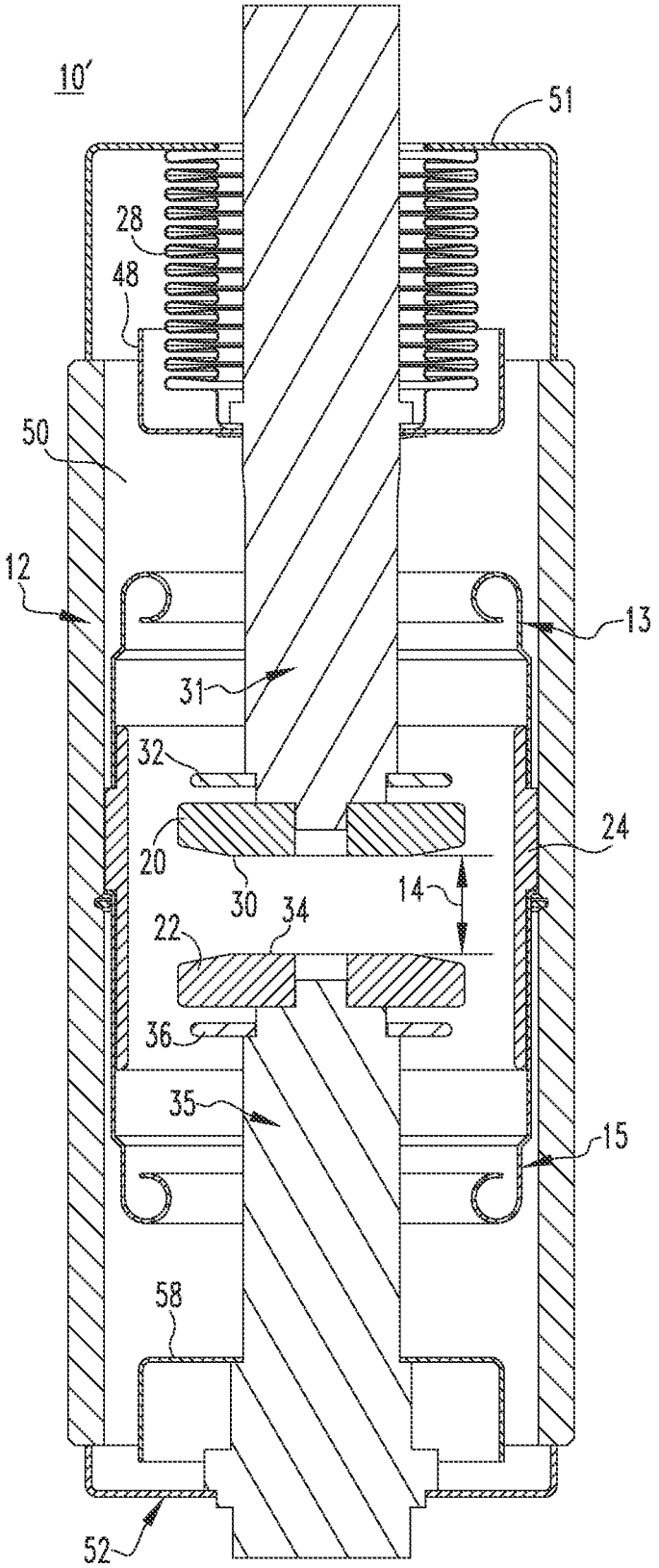
FIG. 2 (PRIOR ART)
FIG. 2 is a sectional view of a vacuum interrupter and an arc-enduring Cu—Cr alloy-based center shield component, in accordance with the prior art.
Figure 2A:
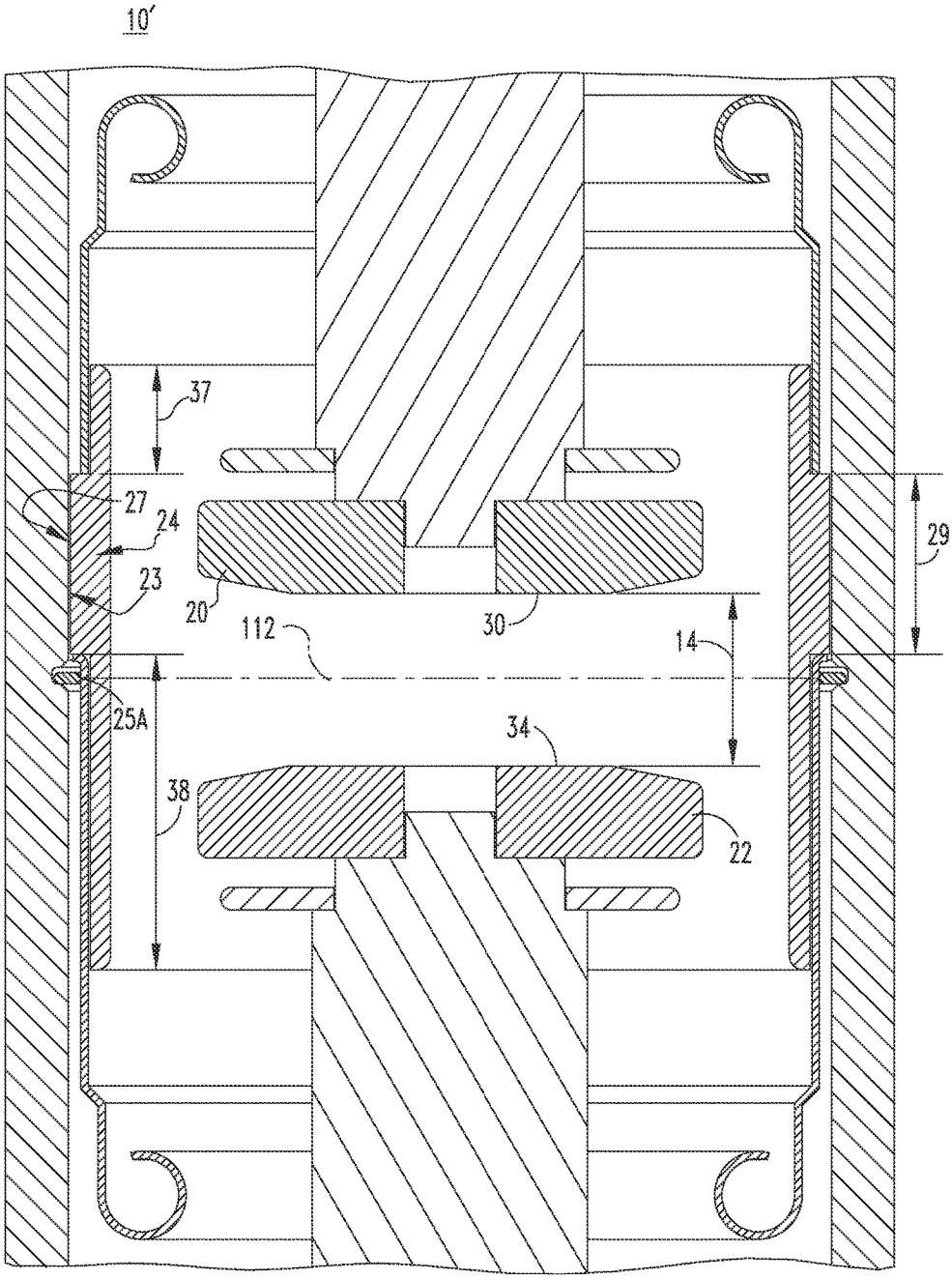
FIG.2A (PRIOR ART)
FIG. 2A is a detail view of FIG. 2 of the contact gap portion, in accordance with the prior art.
Figure 3:
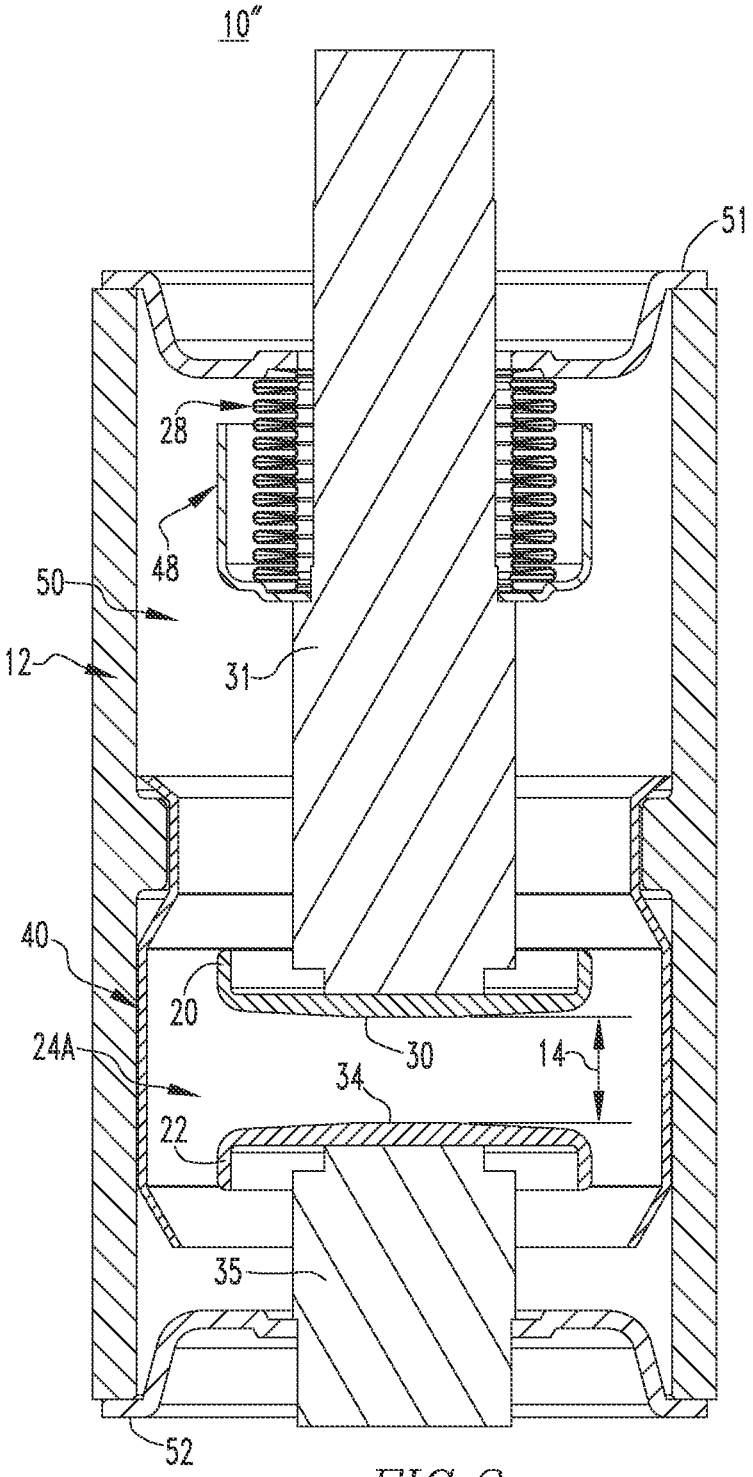
FIG. 3 (PRIOR ART)
FIG. 3 is a sectional view of a vacuum interrupter and a non-arc-enduring (i.e., non-Cu—Cr alloy-based) center shield component, in accordance with the prior art.
Figure 3A:
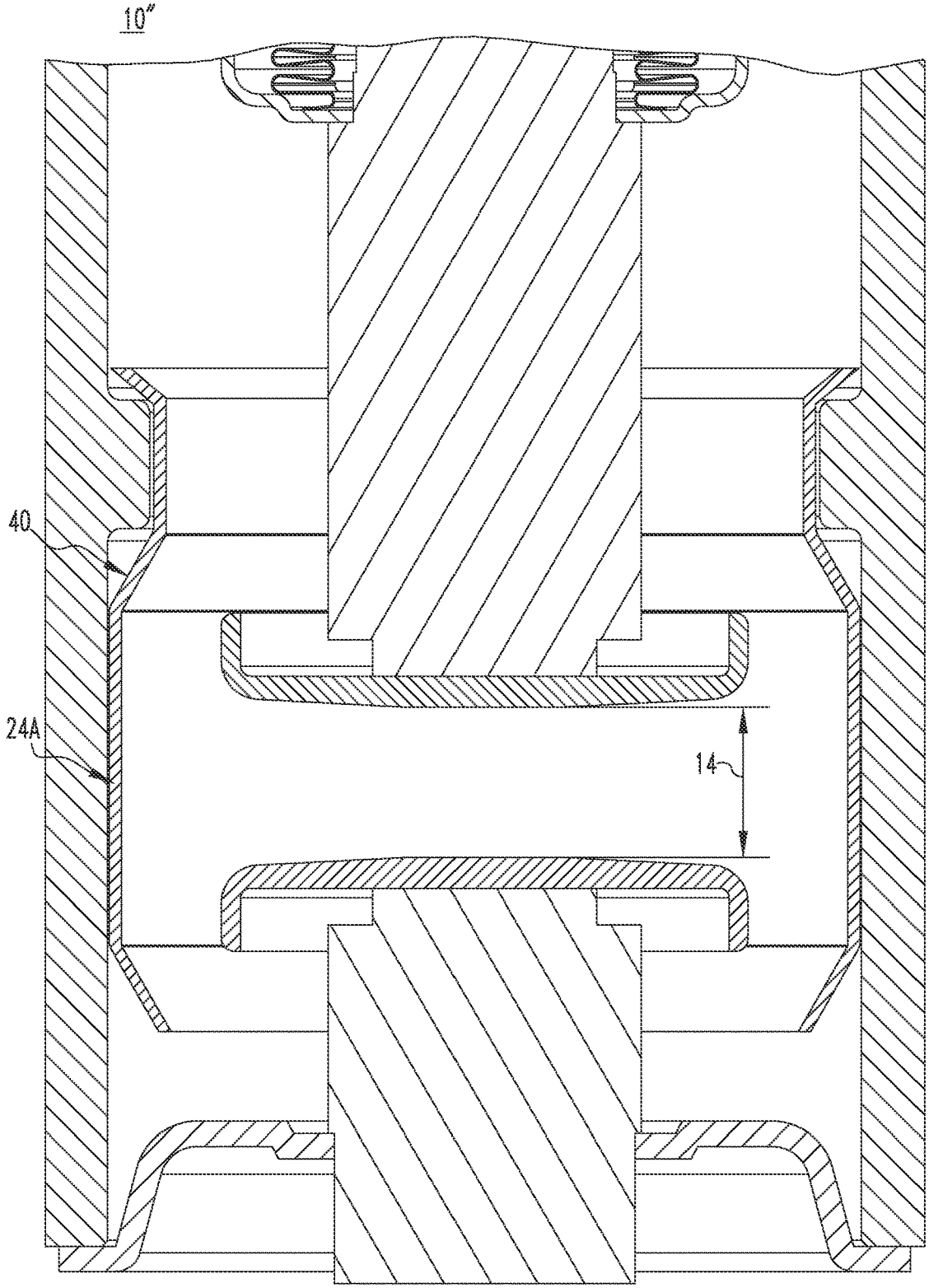
FIG. 3A (PRIOR ART)
FIG. 3A is a detail view of FIG. 3 of the contact gap portion, in accordance with the prior art.

As previously described, FIGS. 1 and 1A show a vacuum interrupter 10 employing a floating arc-enduring Cu—Cr alloy-based center shield component, in accordance with the prior art, that has a space formed between the outer diameter of the center shield component and the inner diameter of the insulating tube, such that the center shield wall thickness and outer diameter is not maximized. FIGS. 2 and 2A show a vacuum interrupter 10' employing a floating arc-enduring Cu—Cr alloy-based center shield component 24, in accordance with the prior art, that has a portion of the shield wall having a maximum thickness and outer diameter. However, this portion is created as a result of positioning a center flange, and the axial gap between the contact assemblies is not positioned to fully align with the portion of the center shield wall having the maximum thickness and outer diameter. FIGS. 3 and 3A show a vacuum interrupter 10" employing a floating center shield component composed of a non-arc-enduring (i.e., non-Cu—Cr alloy-based) material, in accordance with the prior art, that has a shield wall of uniform thickness and outer diameter due to means of securing the non-arc enduring center shield component to the vacuum envelope.

In accordance with the disclosed concept, there is provided a floating center shield component composed of an arc-enduring Cu—Cr alloy-based material having the axial contact gap formed between the contact assemblies substantially entirely aligned with a portion of the wall of the center shield component that has a maximum thickness and outer diameter. Thus, the disclosed concept relates to eliminating empty space between the outer diameter of the wall of the center shield component and the inner diameter of the insulating tube (as shown in FIG. 1A), for increasing, e.g., maximizing, the thickness and outer diameter of at least a portion the wall of the center shield component; and for aligning the contact gap axial position with the portion of the shield wall having a maximum thickness and outer diameter.

Thus, in accordance with the disclosed concept, the thickness and outer diameter of at least a portion of the wall of the center shield component is increased, e.g., maximized, and the distance or space between the outer diameter of the center shield component and the inner diameter of the insulating tube is decreased, e.g., minimized. In certain embodiments, the outer diameter of the wall of the center shield extends to, and is limited by, the inner diameter of the insulating tube, such that essentially the entire void or space is eliminated.

Further, in accordance with the disclosed concept, the contact assemblies are positioned such that the contact gap axial position (formed between the contact assemblies) is outside of or away from, e.g., above or below, a center flange axial position. That is, the contact gap axial position, e.g., the width thereof, substantially fully aligns with the maximum thickness and outer diameter of the center shield wall.

The center shield component (of the center shield assembly) is typically composed of copper-chromium (Cu—Cr) alloy and has arc-erosion characteristics similar to those of the arcing contacts. In certain embodiments, the Cu—Cr alloy includes additional minority alloying elements. In other embodiments, the Cu—Cr alloy does not include additional minority alloying elements. Thus, as used herein, the term "Cu—Cr alloy-based" refers to materials that include additional minority alloying elements and also to materials that do not include additional minority alloying elements. The Cu—Cr alloy-based center shield component is positioned in close proximity to the contacts and is capable of participating actively in arcing, such that it shares the arcing mitigating duties with the contacts. Since the center shield component exhibits arc-erosion characteristics, a larger diameter of the contacts can be used within any given diameter of the ceramic envelope, as compared to the diameter of contacts used with a passive center shield component that does not exhibit arc-erosion characteristics, e.g., is composed of a non-arc-enduring Cu—Cr center material, such as copper (in the absence of chromium) or stainless steel.

Generally, an electrically floating Cu—Cr alloy-based center shield component is secured to the vacuum interrupter envelope with a flange. The flange can be more susceptible to being braze-joined (as shown in FIGS. 1 and 1A) or can be of a snap-ring design, for securement to the ceramic insulating casing. A cylindrically-shaped Cu—Cr alloy-based center shield component can be slid into a ring-shaped flange opening. The maximum outer diameter of the Cu—Cr alloy-based center shield component is limited by the internal diameter of the flange. The maximum outer diameter of the Cu—Cr alloy-based shield component may be no more than a few thousands of an inch larger, e.g., for press fitting, than the smallest value of the inner diameter of the flange. Thus, the maximum diameter of the contacts positioned within the Cu—Cr alloy-based center shield component is limited by the diameter that can be fitted inside the Cu—Cr alloy-based center shield component, without risking the wall of the Cu—Cr alloy-based center shield component being burned through after a significantly large number of shots of fault currents of a high amplitude, and/or long arcing time while enduring large asymmetric currents.

Figure 4:
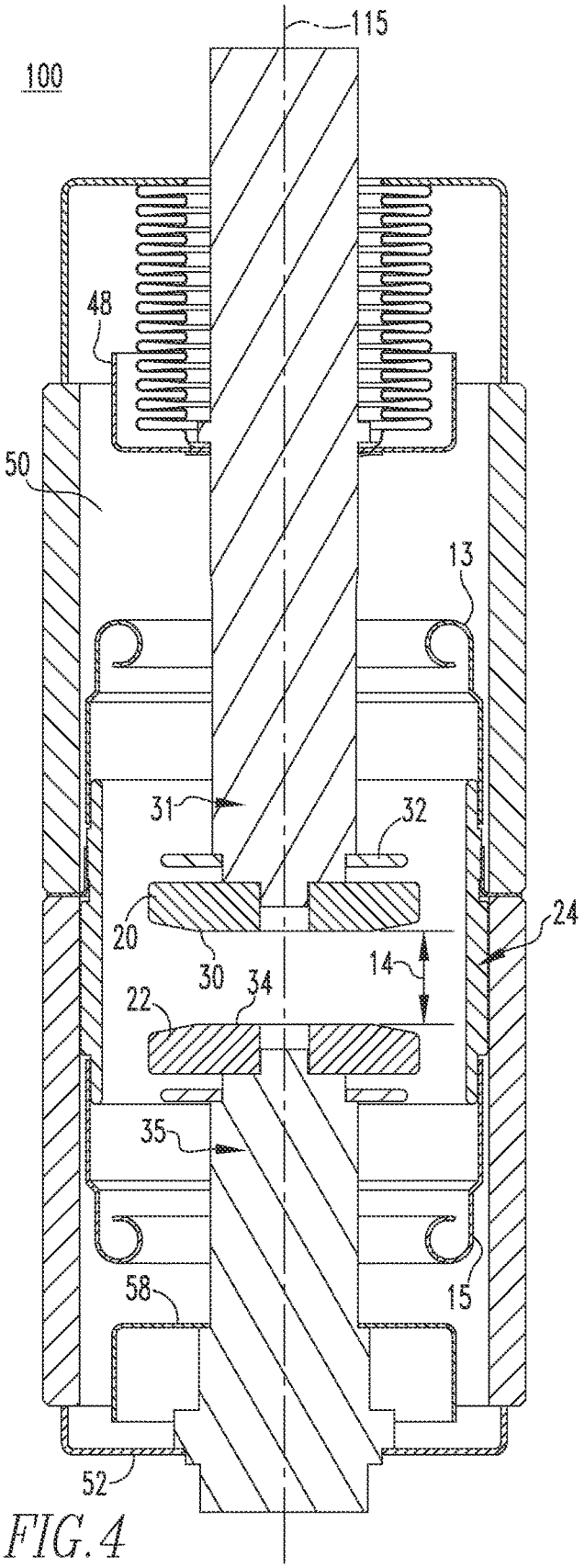
FIG. 4 is a sectional view of a vacuum interrupter and an arc-enduring Cu—Cr alloy-based center shield component, in accordance with the disclosed concept.

FIG. 4 is a schematic that illustrates a vacuum interrupter 100 employing a floating center shield assembly including a center shield component composed of Cu—Cr alloy-based material, in accordance with certain embodiments of the disclosed concept. FIG. 4 includes the insulating tube 12, consisting of two cylindrical pieces, end seals 51 and 52, vacuum envelope 50, arc-enduring Cu—Cr center shield component 24 and opposing metal end components 13, 15 of the center shield assembly, center flange 25, overlaps 37 and 38, first electrode assembly 20, second electrode assembly 22, vacuum envelope 50, bellows 28, bellows shield 48, first electrode contact 30, first terminal post 31, first vapor shield 32, second electrode contact 34, second terminal post 35, second vapor shield 36, end shield 58, and contact gap 14, as shown in FIG. 1. As shown in FIG. 4, the contact gap axial position 14 (formed between the first and second electrode assemblies 20, 22) is located below the center flange axial position 112. As a result, the entire contact gap 14 is in alignment with a portion of the shield wall 29 (shown in FIG. 4A) having a maximum thickness and outer diameter, of the arc-enduring Cu—Cr center shield component 24.

Figure 4A:
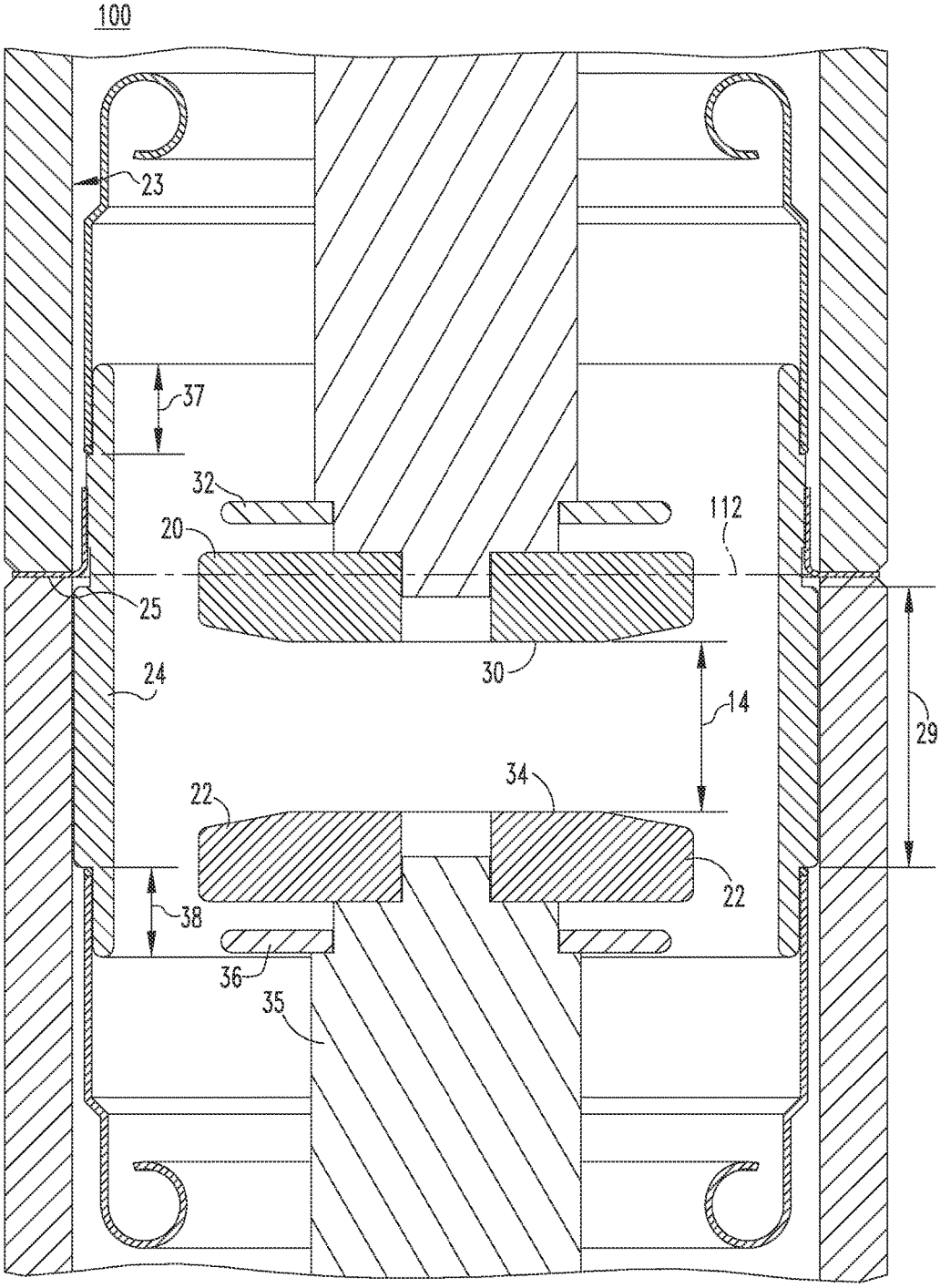
FIG. 4A is a detail view of FIG. 4 of the contact gap portion, in accordance with the disclosed concept.

FIG. 4A is a detail view of the contact gap portion of the vacuum interrupter 100 as shown in FIG. 4. FIG. 4A shows that the outer diameter of the arc-enduring Cu—Cr alloy-based center shield component 24 is not limited by the inner diameter of the center flange 25. As a result, the portion of the shield wall 29 having maximum thickness and outer diameter corresponds to, and fully aligns with, the contact gap axial position 14. The maximum thickness and outer diameter of the shield wall 29 is only limited by the inner diameter 23 of the insulating tube 12 and not limited by the opening of the center flange 25.

Figure 5:
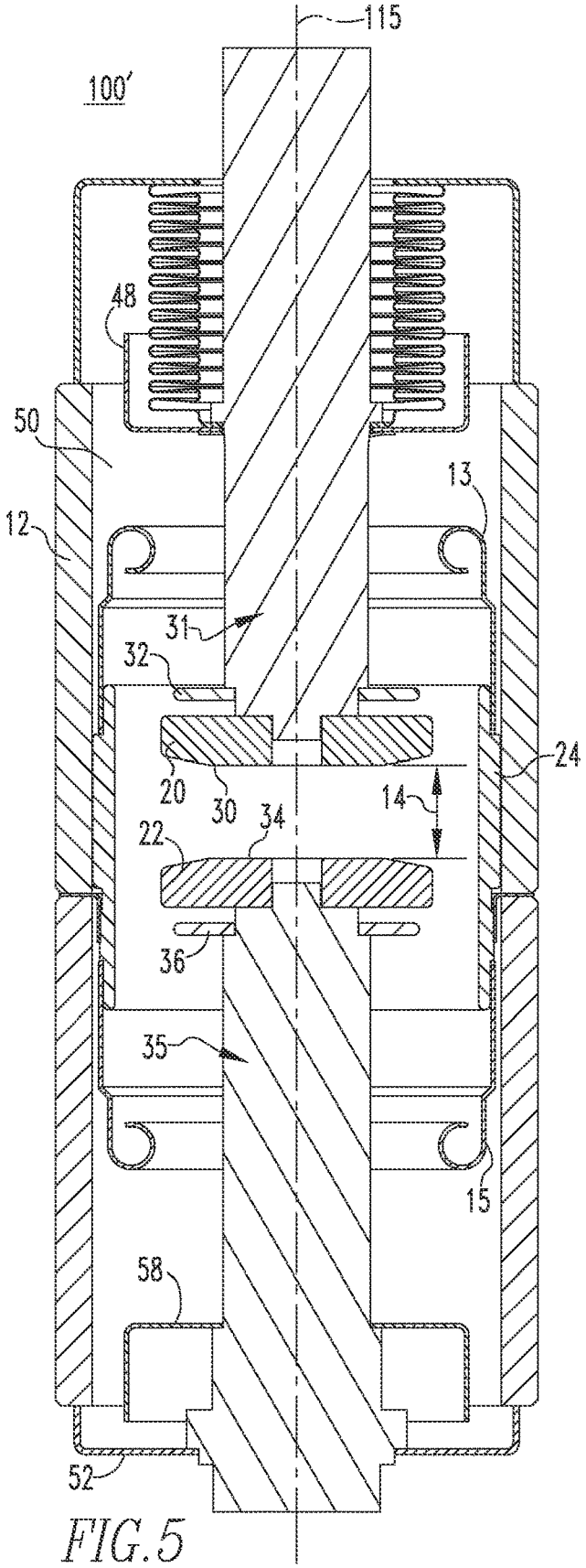
FIG. 5 is a sectional view of a vacuum interrupter and an arc-enduring Cu—Cr alloy-based center shield component, in accordance with the disclosed concept.

FIG. 5 is a schematic that illustrates a vacuum interrupter 100' employing a floating center shield assembly including a center shield composed of Cu—Cr alloy-based material, in accordance with certain embodiments of the disclosed concept. FIG. 5 includes the insulating tube 12, consisting of two cylindrical pieces, end seals 51 and 52, vacuum envelope 50, arc-enduring Cu—Cr center shield component 24 and opposing metal end components 13, 15 of the center shield assembly, center flange 25, overlaps 37 and 38, first electrode assembly 20, second electrode assembly 22, vacuum envelope 50, bellows 28, bellows shield 48, first electrode contact 30, first terminal post 31, first vapor shield 32, second electrode contact 34, second terminal post 35, second vapor shield 36, end shield 58, and contact gap 14, as shown in FIG. 1. As shown in FIG. 5, the contact gap axial position 14 (formed between the first and second electrode assemblies 20, 22) is located above the center flange axial position 112. As a result, the entire contact gap 14 is in alignment with a portion of the shield wall 29 (as shown in FIG. 5A) having a maximum thickness and outer diameter, of the arc-enduring Cu—Cr center shield component 24.

Figure 5A:
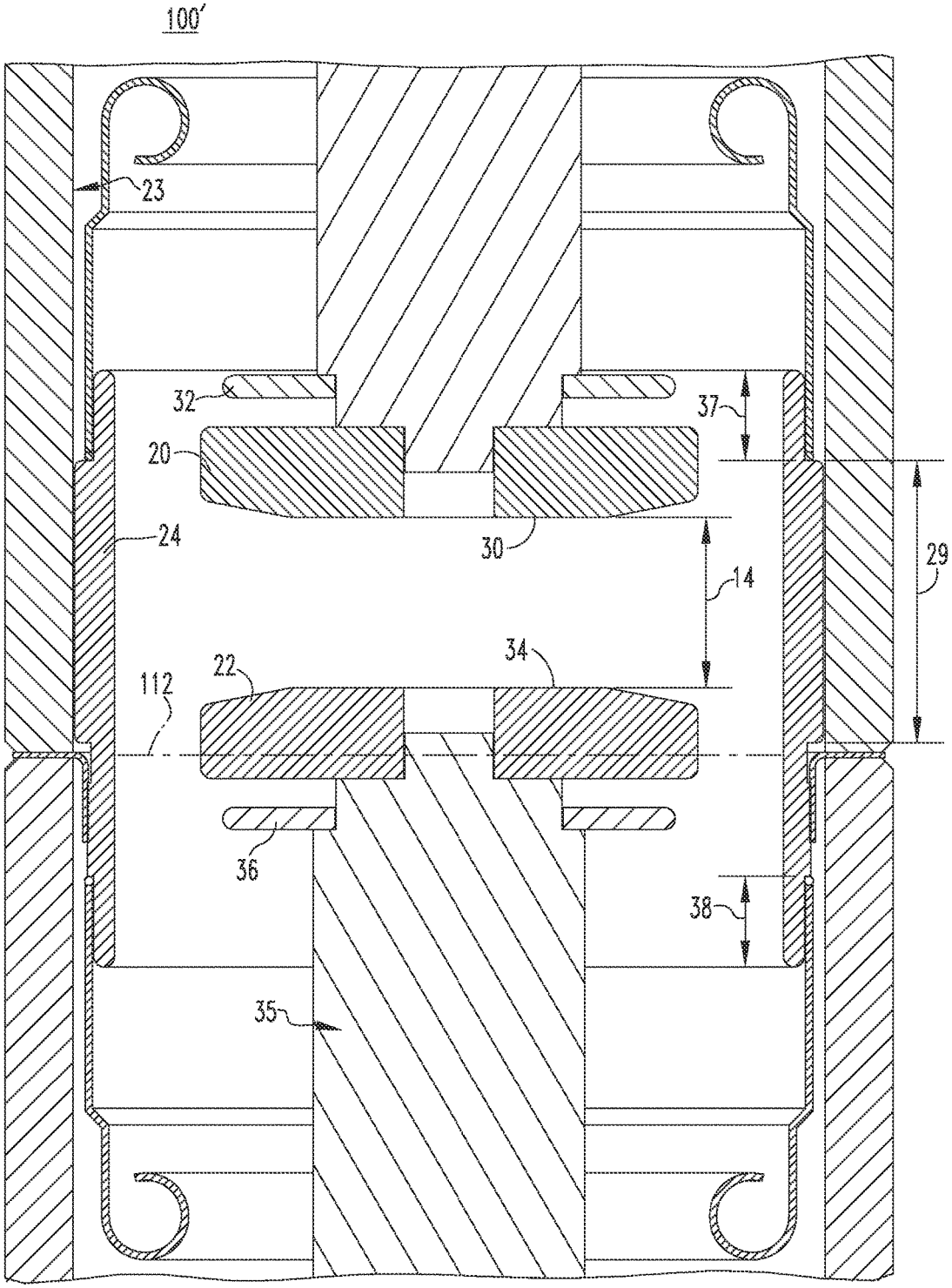
FIG. 5A is a detail view of FIG. 5 of the contact gap portion, in accordance with the disclosed concept.

FIG. 5A is a detail view of the contact gap portion of the vacuum interrupter 100' as shown in FIG. 5. FIG. 5A shows that the outer diameter of the arc-enduring Cu—Cr alloy-based center shield component 24 is not limited by the inner diameter of the center flange 25. As a result, the portion of the shield wall 29 of the arc-enduring Cu—Cr center shield component 24 that corresponds to the contact gap axial position 14, has a maximum thickness and outer diameter, i.e., only limited by the inner diameter 23 of the insulating tube 12 and not limited by the opening of the center flange 25.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A vacuum interrupter, comprising:

an insulating tube having an inner diameter;

a vacuum envelope formed by the insulating tube;

an arc-enduring floating center shield component comprised of Cu—Cr alloy-based material positioned within the vacuum envelope, the floating center shield component comprising:

a first portion of the floating center shield component having a first outer diameter greater than a second outer diameter of a remainder second portion of the floating center shield component; and a shield wall, having a first portion that corresponds to said first portion of the floating center shield component, the first portion of the shield wall having a first thickness greater than a second thickness of a remainder second portion of the shield wall, that corresponds to the remainder second portion of the floating center shield component;

a center flange, having an inner diameter, to secure the floating center shield component to the insulating tube, wherein the first outer diameter of said first portion of the floating center shield component and the first thickness of said first portion of the shield wall extend beyond the inner diameter of the center flange toward the inner diameter of the insulating tube;

a first contact assembly;

a second contact assembly; and a contact gap formed between the first and second contact assemblies when said assemblies are axially in an open position, wherein an entire contact gap is positioned above a corresponding axial position of the center flange, and the entire contact gap is correspondingly aligned within said first portion of the floating center shield component that is located above the center flange, or wherein an entire contact gap is positioned below a corresponding axial position of the center flange, and the entire contact gap is correspondingly aligned within said first portion of the floating center shield component that is located below the center flange.

2. The vacuum interrupter of claim 1, wherein said first portion of the floating center shield component has an outer diameter that extends to or near the inner diameter of the insulating tube.

3. The vacuum interrupter of claim 1, wherein the contact gap is aligned with said first portion of the shield wall, which is located a distance away from where the center flange is attached to the shield wall.

4. The vacuum interrupter of claim 1, wherein the center flange has a ring-shaped opening formed therein.

5. The vacuum interrupter of claim 4, wherein the outer diameter of said first portion floating center shield component is greater than an inner diameter of the opening of the center flange.

6. The vacuum interrupter of claim 1, wherein the insulating tube is composed of ceramic.

7. The vacuum interrupter of claim 1, wherein the floating center shield component has connected thereto opposing ends composed of metal.

* * * * *